United States Patent [19]

Tallon

[11] 4,250,218

[45] Feb. 10, 1981

[54] FLOOR COVERING

[75] Inventor: Roger Tallon, Paris, France

[73] Assignee: Design Programmes, Paris, France

[21] Appl. No.: 60,620

[22] Filed: Jul. 25, 1979

Related U.S. Application Data

[63] Continuation-in-part of Ser. No. 959,448, Nov. 13, 1978, abandoned, which is a continuation of Ser. No. 794,622, May 2, 1977, abandoned.

[51] Int. Cl.[3] ..... B32B 3/00; B32B 3/30

[52] U.S. Cl. ..... 428/166; 428/172; 428/178; 428/213; 428/332

[58] Field of Search ..... 428/157, 178, 180, 158, 428/166, 212, 213, 214, 220, 332, 172; 156/210, 145; 16/1 R

[56] References Cited

U.S. PATENT DOCUMENTS

| | | | |
|---|---|---|---|
| 2,633,442 | 3/1953 | Caldwell | 156/210 |
| 2,737,693 | 3/1956 | Robbins | 20/7 |
| 3,423,263 | 1/1969 | Pannone | 428/178 |
| 3,813,279 | 5/1974 | Varner, Jr. | 428/178 |

FOREIGN PATENT DOCUMENTS

| | | |
|---|---|---|
| 300448 | 7/1972 | Austria . |
| 2055959 | 6/1971 | Fed. Rep. of Germany . |
| 2064718 | 7/1971 | Fed. Rep. of Germany . |
| 2320623 | 11/1973 | Fed. Rep. of Germany . |
| 2509073 | 11/1975 | Fed. Rep. of Germany . |
| 1125195 | 7/1956 | France . |
| 1293043 | 4/1962 | France . |
| 1487003 | 4/1969 | France . |
| 1229516 | 4/1971 | United Kingdom . |

*Primary Examiner*—Paul J. Thibodeau
*Attorney, Agent, or Firm*—Lewis H. Eslinger

[57] ABSTRACT

The invention relates to a floor covering produced in sheets of relatively resilient material and provided on its lower face with hollow cells confining pockets of air on the floor. The upper face may be provided with bulges corresponding to said hollow cells. These arrangements increase the suppleness, the reliability, and the comfort.

8 Claims, 12 Drawing Figures

FLOOR COVERING

This application is a continuation-in-part of U.S. Patent Application Ser. No. 959,448 filed November 13, 1978, now abandoned, which is a continuation of U.S. Patent Application Ser. No. 794,622 filed May 2, 1977, also now abandoned.

The present invention concerns floor coverings in general, and more particularly, a floor covering presenting new advantages, with respect to its manufacturing and laying costs, and especially with respect to its performances with regard to suppleness, reliability, comfort, soundproofing and serviceability.

To this end, a floor covering according to the invention, produced in elements from a relatively resilient material such as rubber or plastic, whose lower face, which is intended to rest upon the floor, comprises a plurality of hollow cells spaced apart from one another in a regular configuration, is characterized in that the bases of the said hollow cells are spaced out with respect to one another and separated from the other by plane portions of the lower face of the said elements which plane portions are intended to rest upon the floor.

Such a floor covering has the following advantages:

compared with a conventional covering which may be provided on its visible face with raised decorative or useful designs, and whose inner face is plane for adhering to the floor, a covering according to the invention requires less raw material for its manufacture due to the provision of the lower hollow cells. The saving in raw material realized as a result of the reduction in weight of the product may reach 20%;

for its adhesive application on the floor, adhesives are used only on the plane portions of the lower surface, and not on the concave surfaces of the cells. The saving realized may easily reach and exceed a value of the order of 50% depending on the shape and disposition of the cells on the lower plane surface of the covering;

due to the fact that, following the adhesive application of the covering into the floor, pockets of air are confined, in nearly sealed manner, within each cell, it follows that: an improved contact resiliency is obtained; the reliability is improved in the event of slipping on coverings on horizontal and especially inclined floors; comfort is improved on account of the feeling of suppleness derived from walking or when wheeling a vehicle; soundproofing is improved; it is possible to use a relatively hard material to produce this covering, and yet to obtain a relative suppleness of the final product.

The invention will be more readily understood on reading the following description with reference to the accompanying drawings in which.

The floor covering 1 according to the invention may be produced with plane elements such as squares, sheets or continuous rolls. It is exposed when in use to form a wear surface 1*a*.

A relatively resilient material, of any known type, such as a hard synthetic rubber compound able to withstand abrasion, or any plastic material, etc. may be used. Such material should be relatively resilient yet hard, i.e. it should have a shore hardness of between 75 and 95.

Figure 1:
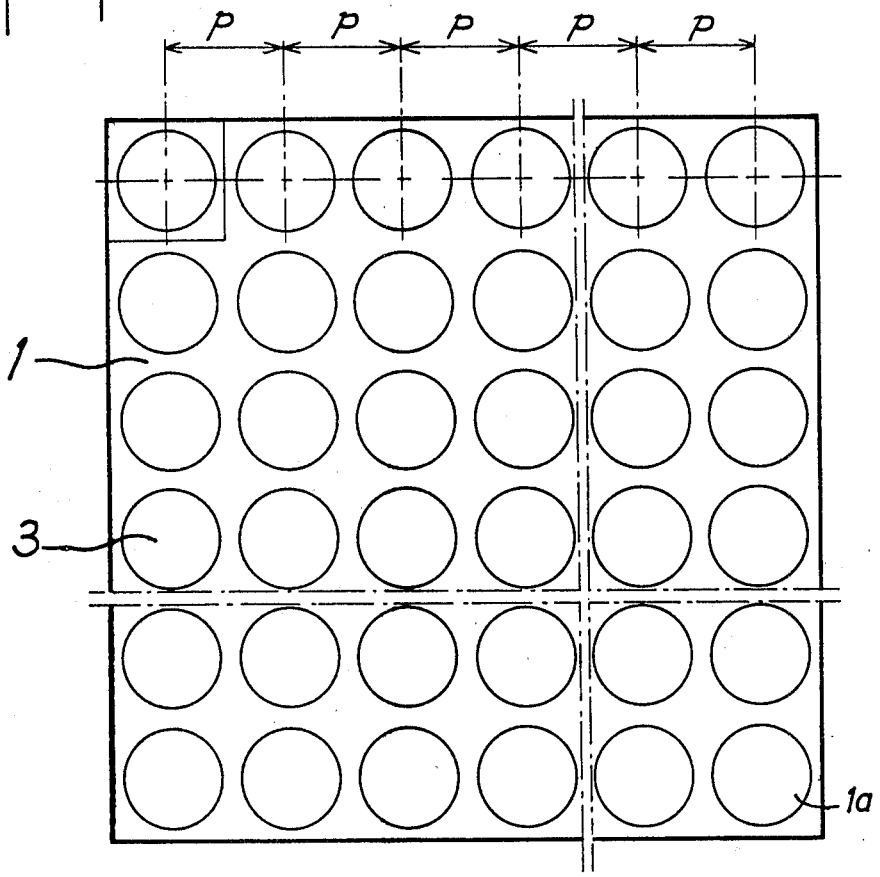
FIG. 1 is a plan view of a particular embodiment of a floor covering according to the invention.
Figure 2:
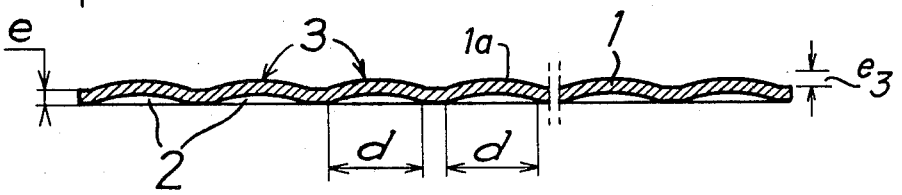
FIG. 2 is a sectional view of the elementary square according to FIG. 1

The covering element as illustrated in FIGS. 1 and 2 is provided on its inner face with hollow cells 2, shaped as substantially spherical domes or cupolas.

The diameter d of the circular base of said domes and their pitch are selected, for example as shown in the drawing, so that the total plane surface of the lower face of the covering, which lower face is intended to rest on the floor to be covered, is substantially equal to the total surface of the circular bases of the domes 2 at the lower surface of the covering.

More generally, the values of parameters d and p are selected so that the ratio value of the first surface to the second varies between 5 and 0.5. In addition, the spacing between the domes (i.e. p-d) is between 2 and 10 millimeters.

Also, the value of the thickness e of the sheet of material 1 and the maximum diameter d of the domes, is selected for example as shown on the drawing, so that their ratio value varies between 0.1 and 0.2.

More specifically, the thickness e of the sheet 1 is preferably between 2 and 4 millimeters while the diameter d of the domes is between five and ten times the thickness e, i.e. $5e < d < 10e$.

These combined selections insure that the aforesaid advantages are obtained.

Preferably, raised portions, constituted in this case by upper domes or bulges 3, correspond to each lower hollow dome. This characteristic arrangement makes it possible to improve the aforesaid performances of this new covering and also to give to the upper face a favorable aesthetic appearance. Preferably the height (i.e. the dimension $e_3$) of these upper domes or bulges, above the upper surface of the sheet is between 0.5 and 2 millimeters.

The hollow cells 2, once the covering is laid, on the floor, are intended to retain virtually sealed pockets of the air.

Figure 3:
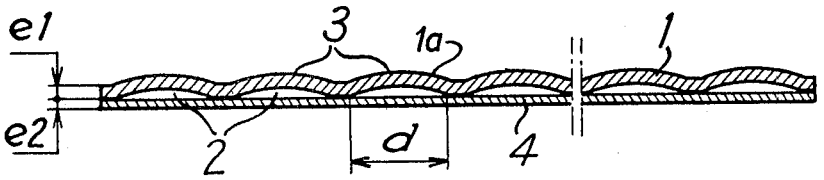
FIG. 3 is a sectional view of another embodiment of the floor covering according to the invention.

In the example shown in FIG. 3, a continuous plane underlay $e_2$ is added to the lower face of the covering, so that said pockets of air are formed before even the covering is laid on the floor. This underlayment, which may be formed of the same material as sheet 1, preferably has a thickness of between 1 and 2 millimeters.

In this way, the formation of said pockets is actually insured at the time of manufacture of the product and can no longer be faulty when the covering is laid on the floor, by way of adhesive application for example.

FIG. 2 shows a sectional view of such a covering.

Underlay 4, which is smooth, is added on to the underpart of a floor covering according to the invention by way of any adequate means: vulcanization, adhesives or clipping.

The smooth lower face of the underlay 4 enables easy laying of the covering without it being necessary, for example during an adhesive application, to take any precaution whatsoever to constitute the plurality of air pockets giving to the said covering its advantageous characteristics.

This lay-out is, as illustrated, the same assembly of hollow cells with the larger base d and regularly spaced out with respect to one another according to a pitch p.

Figure 4:
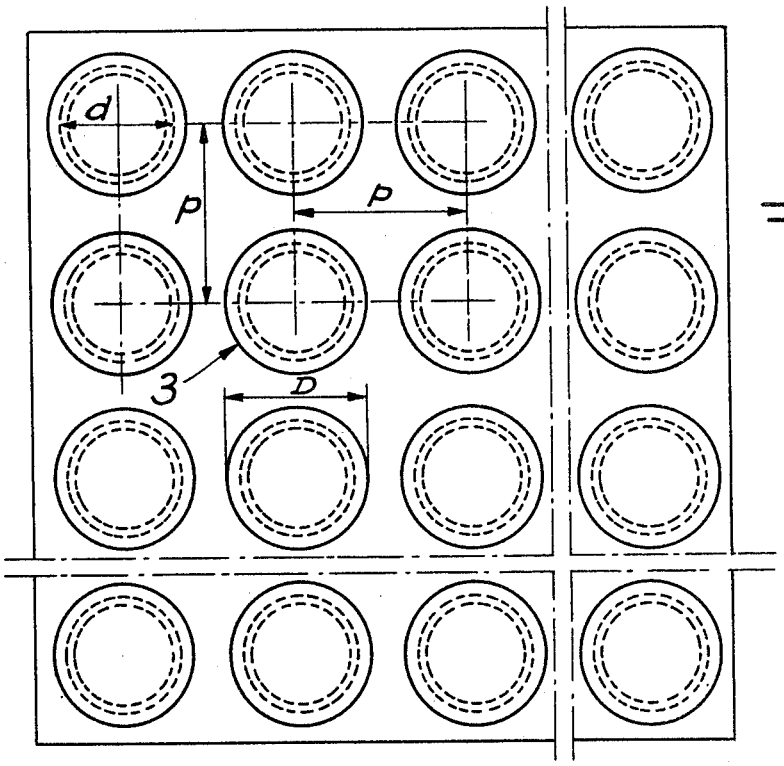
FIGS. 4, 5 and 6 are plan views illustrating various possible configurations of associated raised portions and hollow cells in a floor covering according to the invention.

According to FIG. 4, the upper raised portions are merely spherical domes 3 of diameter e, each one of which corresponds to a lower hollow cell.

Figure 5:
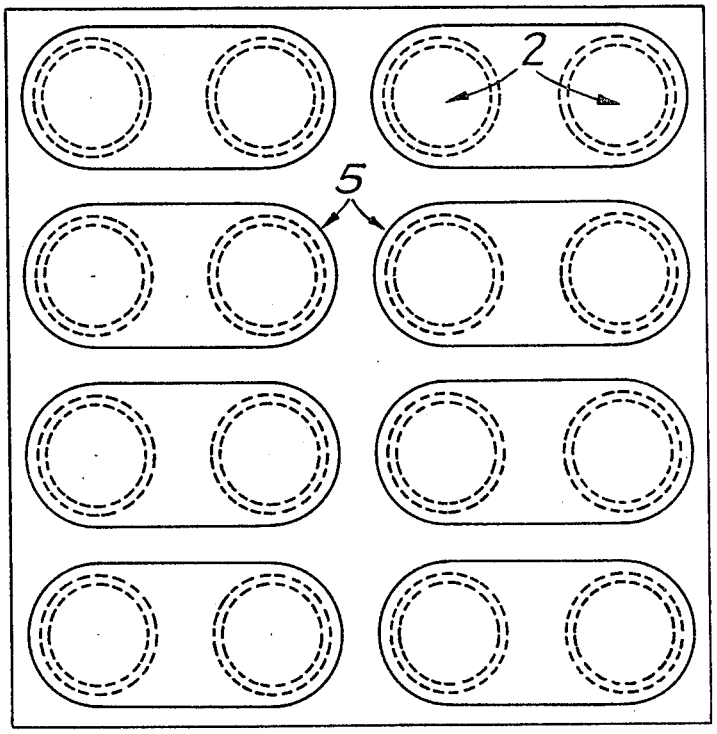

According to FIG. 5, the upper raised portions are pseudoellipses 5, to each one of which correspond two hollow cells 2.

Figure 6:
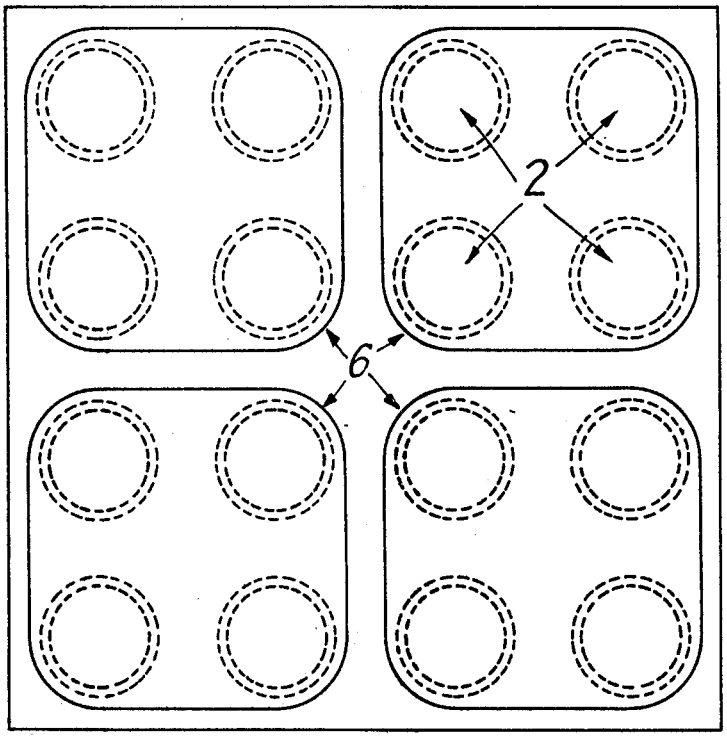
Figure 7:
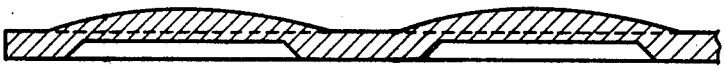
FIGS. 7 to 12 are sectional views illustrating various possible designs of hollow cells associated to the three types of raised portions shown in FIGS. 4 to 6.
Figure 8:
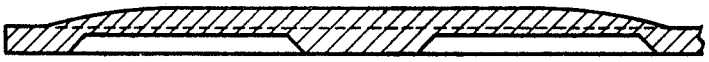
Figure 9:
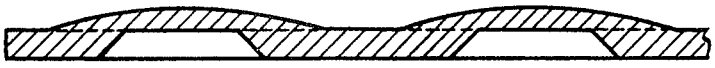
Figure 10:
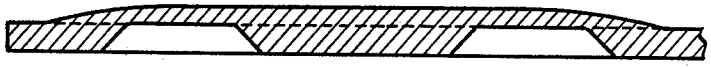
Figure 11:
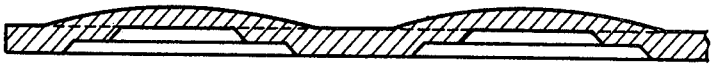
Figure 12:
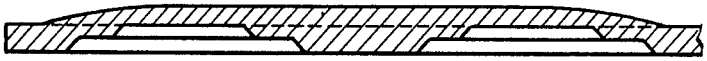

According to FIG. 6, the upper raised portions are squares with rounded edges 6, to each one of which square corresponding four hollow cells 2.

FIGS. 7 and 8, 9 and 10, and 11 and 12 respectively show, on a larger scale three different designs of cells which can be associated to the three types of raised portions shown in FIGS. 4, 5 and 6.

These examples are given in order to show that there are multiple ways of selecting the design of the lower cells, their dimensions, their relative position as well as that of any possible upper raised portions corresponding thereto. Preferably, said raised portions will be designed so that they have no sharp edges.

What is claimed is:

1. A tile floor covering comprising a sheet of hard resilient material having a Shore hardness within the range of 75 to 95, said sheet including upper and lower faces with said lower face being adapted to rest on a floor to be covered and said upper face acting as an exposed wear surface, and a plurality of hollow cells formed in said sheet, each of which opens at a respective base thereof on the lower face of said sheet with said base including the greatest dimension of the respective cell, said hollow cells being regularly spaced and separated from one another by planar portions of the sheet, wherein the ratio of the total surface area of such planar portions at the lower face to the total area of the bases of said hollow cells on the lower face of the sheet is between 0.5 and 5, said sheet further having a substantially uniform thickness throughout said hollow cells and planar portions, wherein the ratio of the thickness of the sheet to said greatest dimension of the hollow cells at the bases thereof is between 0.1 and 0.2.

2. A covering as defined in claim 1 including a flat sheet secured to said lower face of said sheet of resilient material for closing said cells and forming air pockets therein.

3. A covering as defined in claim 2 wherein said hollow cells form raised designs on said upper face of the sheet.

4. A covering as defined in claim 3 wherein the maximum height of said raised designs above the planar portions of the sheet between the cells is approximately equal to the thicknes of the sheet.

5. A floor covering as defined in claim 1 wherein said sheet has a thickness of between 2 and 4 millimeters.

6. A floor covering as defined in claim 1 wherein said hollow cells project above the flat upper surface portions of said sheet by a distance of between 0.5 and 2 millimeters.

7. A floor covering as defined in claim 1 wherein the minimum distance between adjacent peripheries of said hollow cells is between 2 and 10 millimeters.

8. A tile floor covering comprising a sheet of hard resilient material having a thickness in the range of 2 to 4 millimeters and a Shore hardness in the range of 75 to 95, said sheet including upper and lower surfaces with said lower surface being adapted to rest on a floor to be covered and said upper surface acting as an exposed wear surface and having a flat portion, and a plurality of hollow cells formed in said sheet, each of which opens at the lower surface of said sheet at a respective base thereof and projecting above the flat portion of the upper surface of said sheet by a distance in the range of 0.5 to 2 millimeters, said hollow cells being regularly spaced and separated from one another by planar portions of the sheet, wherein the ratio of the total surface area of said planar portions at the lower surface of the sheet to the total area of the bases of the hollow cells on the lower surface of the sheet is within the range of 0.5 and 5, said sheet further having a substantially uniform thickness throughout said hollow cells and planar portions, wherein the ratio of the thickness of the sheet to the diameter of the bases of the hollow cells is within the range of 0.1 to 0.2.

* * * * *